US010377548B2

(12) United States Patent
Bourgoin et al.

(10) Patent No.: US 10,377,548 B2
(45) Date of Patent: Aug. 13, 2019

(54) RESEALABLE CONTAINER FOR CONSUMER ARTICLES WITH IMPROVED MOISTURE CONTROL

(71) Applicant: PHILIP MORRIS PRODUCTS S.A., Neuchatel (CH)

(72) Inventors: Philippe Bourgoin, Echallens (CH); Elke Rutzinger, Bergdietikon (CH); Arjen Hamilcar Slooff, Rhenen (NL)

(73) Assignee: Philip Morris Products S.A., Neuchatel (CH)

( * ) Notice: Subject to any disclaimer, the term of this patent is extended or adjusted under 35 U.S.C. 154(b) by 37 days.

(21) Appl. No.: 15/571,062

(22) PCT Filed: May 26, 2016

(86) PCT No.: PCT/EP2016/061945

§ 371 (c)(1),
(2) Date: Nov. 1, 2017

(87) PCT Pub. No.: WO2016/189108

PCT Pub. Date: Dec. 1, 2016

(65) Prior Publication Data

US 2018/0354695 A1 Dec. 13, 2018

(30) Foreign Application Priority Data

May 26, 2015 (EP) ..... 15169280

(51) Int. Cl.
*B65D 85/10* (2006.01)
*B65D 75/58* (2006.01)

(52) U.S. Cl.
CPC ..... *B65D 75/5838* (2013.01); *B65D 85/1027* (2013.01); *B65D 85/1045* (2013.01); *B65D 85/1054* (2013.01)

(58) Field of Classification Search
USPC ..... 206/264, 265, 268, 271, 273
See application file for complete search history.

(56) References Cited

U.S. PATENT DOCUMENTS 6,237,760 B1 * 5/2001 Parker ..... B65D 75/5838 206/273
8,091,703 B2 1/2012 Marchetti
(Continued)

FOREIGN PATENT DOCUMENTS

EP 2243716 10/2010
EP 2657926 10/2013
(Continued)

OTHER PUBLICATIONS

European Extended Search report for Application No. 15169280.3 dated Feb. 26, 2016 (11 pages).
(Continued)

*Primary Examiner* — Jacob K Ackun
(74) *Attorney, Agent, or Firm* — Mueting, Raasch & Gebhardt P.A.

(57) ABSTRACT

A package (18) of consumer goods has an opening for removing the goods and a reclosable adhesive label (22) occluding the opening. The label (22) comprises a bottom layer (24) and a top layer (26). The bottom layer (24) is affixed to the package (18) by means of permanent adhesive provided on a first area (30) of the inner surface of the bottom layer extending about the periphery of the opening, the bottom layer comprising a cut-out portion (28) at least partly aligned with the opening of the package. The top layer (26) is at least partly affixed to the bottom layer (24) by permanent adhesive provided on a back hinge area (32) of the inner surface of the top layer, and at least partly releasably affixed to the bottom layer by means of a second adhesive provided on a peeling area (34) of the inner surface of the top layer extending distal from the hinge area (32).
(Continued)

Thus, the top layer (26) is movable from a closed position, wherein it overlies at least the access opening, and an open position, wherein it is lifted off the bottom layer (24) to reveal the cut-out portion (28). The second adhesive is a permanent or semi-permanent adhesive and a layer of a release agent is provided between the bottom layer (24) and the top layer (26). In the closed position, a front end portion of the peeling area (34) of the inner surface of the top layer (26) at least partially overlies the release agent.

13 Claims, 3 Drawing Sheets

(56) References Cited

U.S. PATENT DOCUMENTS

| | | | | |
|---|---|---|---|---|
| 9,394,085 | B2 | 7/2016 | Nakano | |
| 2005/0276525 | A1 | 12/2005 | Hebert | |
| 2011/0147443 | A1 | 6/2011 | Igo | |
| 2012/0006823 | A1* | 1/2012 | Bertuzzi | B65D 75/5838 220/270 |
| 2015/0151885 | A1 | 6/2015 | Nakano | |
| 2018/0105353 | A1* | 4/2018 | Bellamah | B31B 50/00 |

FOREIGN PATENT DOCUMENTS

| | | |
|---|---|---|
| JP | 2013/249127 | 12/2013 |
| RU | 2455214 | 7/2012 |
| WO | 02/079051 | 10/2002 |
| WO | 98/22367 | 12/2002 |
| WO | WO 2008/142540 | 11/2008 |
| WO | WO 2013/120916 | 8/2013 |
| WO | WO 2016/059077 | 4/2016 |

OTHER PUBLICATIONS

Office Action issued in Singapore for Application No. 11201708921S dated Aug. 30, 2018 (10 pages).
International Search Report and Written Opinion for PCT/EP2016/061945 dated Sep. 9, 2016 (14 pages).
International Preliminary Report on Patentability for PCT/EP2016/061945 dated Jul. 18, 2017 (40 pages).
Office Action issued in Kazakhstan for Application No. 2017/1031.1 dated Mar. 6, 2019 (11 pages). English translation included.

* cited by examiner

RESEALABLE CONTAINER FOR CONSUMER ARTICLES WITH IMPROVED MOISTURE CONTROL

The present invention relates to a container for consumer goods comprising a reclosable adhesive label. In particular, the container of the present invention finds application as a container for elongate consumer good items, such as smoking articles.

Smoking articles are typically packaged in rigid hinge-lid containers. The bundle of smoking articles housed in the box is commonly wrapped in an inner liner, or package, of metallised paper, metal foil or other flexible sheet material. A sealed condition of the inner package is appreciated by consumers as proof that the goods inside the package are preserved in their original form at least until the first opening of the container.

Containers are known, for example from WO-A-2008/142540, wherein the smoking articles are enclosed in an inner package with an extraction opening removably closed by a cover flap that is releasably affixed to the inner package using non-dry adhesive applied to the underside of the cover flap. Such packages may be received in a hinge-lid container, the cover flap being glued permanently and non-removably to an inner surface of the front wall of the lid so that opening and closing of the lid simultaneously opens and closes the cover flap, thus revealing the extraction opening. WO 2016/059077 discloses a different resealable container, wherein the access opening in the package is covered by at least two layers of labelling web material. A first layer is applied directly onto the package by a first adhesive. The second layer is applied onto the first layer and is structured and functions substantially as a self-adhesive reclosable sticker adhesive label that can be removed from, and reattached to, the first layer several times. Prior to being opened for the first time, such containers help preserve the moisture content of the consumer goods within the container under dry external conditions and may just as well protect the consumer goods against moisture uptake in tropical climates. However, in order to facilitate opening, the cover flap is affixed to the inner package by means of a low-strength, resealable adhesive and so, after repeated opening and re-closing of the cover flap, the sealing efficiency of one such cover flap may therefore decrease, to the point where, especially under extreme climates (for example, tropical climates or desert climates), it may become difficult to maintain the desired moisture content within the inner pack.

Some types of tobacco products are extremely sensitive to variations in their moisture content. Typically, variations in the range of plus or minus 5 percent, and sometimes even as low as plus or minus 1 percent, can impact the taste or performance of such tobacco products. Accordingly, a need is felt in the art to improve the moisture barrier properties of containers for consumer articles.

Several solutions have been proposed to meet such need. However, while the containers disclosed therein display improved moisture barrier properties prior to the first opening of the inner package, they do not fully address the issues associated with the use of the container under extreme weather conditions.

Therefore, it would be desirable to provide a novel and improved resealable container for consumer goods such that a predetermined moisture content of the goods within the container can be maintained both prior to the first opening of the inner package and during regular use of the container. Further, it would be desirable to provide an improved resealable container for consumer goods that is capable of preserving a desirable moisture content of the goods even when the container is exposed to extreme weather conditions.

Another relevant parameter for resealable containers for consumer goods of the type described above is the force required for opening the container (that is, the 'opening force' of the container), and even more particularly the force required for opening the container for the first time. It has been observed that the force required for opening the container is generally maximum when the reclosable adhesive label is peeled off the surface of the package for the first time, and it decreases during use with repeated opening and re-closing of the container. It has also been observed that containers with an opening force at the first opening of about 18 Newtons or more have been considered inconvenient. On the other hand, containers with an opening force of 12 Newtons or less have generally been considered to be easy to open. Accordingly, it would also be desirable to provide a resealable container that may generally be considered to be easy to open.

According to an aspect of the present invention there is provided a resealable container for consumer goods comprising: a package of consumer goods, the package having an access opening through which consumer goods can be removed; and a reclosable adhesive label occluding the access opening of the package and extending beyond the periphery of the access opening of the package, wherein the reclosable adhesive label comprises at least a bottom layer and a top layer of labelling material. The bottom layer is affixed to the package by means of a first, permanent adhesive provided on a first area of the inner surface of the bottom layer extending about the periphery of the access opening, the bottom layer comprising a cut-out portion at least partly aligned with the access opening of the package. The top layer is at least partly permanently affixed to the bottom layer by means of a permanent adhesive provided on a back hinge area of the inner surface of the top layer, and at least partly releasably affixed to the bottom layer by means of a second adhesive provided on a peeling area of the inner surface of the top layer extending distal from the hinge area, such that the top layer is movable from a closed position, wherein the top layer overlies at least the access opening, and an open position, wherein the top layer is lifted off the bottom layer to reveal the cut-out portion. The second adhesive is a permanent or semi-permanent adhesive and the resealable container further comprises a layer comprising a release agent provided between the bottom layer and the top layer, such that, in the closed position, a front end portion of the peeling area of the inner surface of the top layer at least partially overlies the layer comprising the release agent.

According to a further aspect of the present invention, there is provided a hinge lid container comprising a box; a lid hinged to the box along a hinge line extending across a back wall of the container; and a resealable container within the box. The resealable container comprises a package of consumer goods, the package having an access opening through which consumer goods can be removed; and a reclosable adhesive label occluding the access opening of the package and extending beyond the periphery of the access opening of the package, wherein the reclosable adhesive label comprises at least a bottom layer and a top layer of labelling material. The bottom layer is affixed to the package by means of a first, permanent adhesive provided on a first area of the inner surface of the bottom layer extending about the periphery of the access opening, the bottom layer comprising a cut-out portion at least partly aligned with the access opening of the package. The top layer is at least partly permanently affixed to the bottom layer by means of a permanent adhesive provided on a back hinge area of the inner surface of the top layer, and at least partly releasably affixed to the bottom layer by means of a second adhesive provided on a peeling area of the inner surface of the top layer extending distal from the hinge area, such that the top layer is movable from a closed position, wherein the top layer overlies at least the access opening, and an open position, wherein the top layer is lifted off the bottom layer to reveal the cut-out portion. The second adhesive is a permanent or semi-permanent adhesive and the resealable container further comprises a layer comprising a release agent provided between the bottom layer and the top layer, such that, in the closed position, a front end portion of the peeling area of the inner surface of the top layer at least partially overlies the layer comprising the release agent.

It will be appreciated that any features described with reference to one aspect of the present invention are equally applicable to any other aspect of the invention.

As used herein, the terms "front", "back", "upper", "lower", "top", "bottom" and "side", refer to the relative positions of portions of containers according to the invention and components thereof when the container is in an upright position with the lid of the outer housing in the closed position and the hinge line at the back of the container. When describing containers according to the present invention, these terms are used irrespective of the orientation of the container being described. The back wall of the outer housing is the wall comprising the hinge line. The access opening of the package is arranged in an upper portion of the package, such that the access opening extends at least partly across a top wall of the inner package. Where the whole of the access opening is formed in the top wall of the inner package, the front edge of the access opening is in a front portion of the top wall of the inner package. Where the access opening extends across the top wall and the front wall of the inner package, the front edge of the access opening is also the lower edge of the access opening and is located in a upper portion of the front wall of the inner package.

The term "longitudinal" refers to a direction from bottom to top or vice versa. The term "transverse" refers to a direction perpendicular to the longitudinal direction.

The term "cut-out" is used to describe a portion of a surface of the bottom layer wherein, along at least part of the periphery of said cut-out portion, the labelling material from which the bottom layer is formed has been weakened, such as by forming a creased line, a perforated line, a pre-cut line or by ablating some of the material. In some embodiments, cut lines may be formed all along the whole periphery of the cut-out portion, and so the cut-out portion of the inner layer is entirely separable from the remainder of the inner layer to effectively define an opening in the inner layer. In other embodiments, lines of weakness such as cut lines are formed only along three sides of the cut-out portion, such that the cut-out portion defines a cover portion that is only partly separable from the remainder of the inner layer and is substantially hinged to the remainder of the inner layer along a line connecting the free end points of the cut lines. When such cover portion is lifted off the plane defined by the remainder of the inner layer, elements of the container arranged underneath the inner layer, such as the access opening of the package, may thus become exposed to, and accessible for, the consumer.

The term "width" is used to describe the dimension of an element of a label or flap of a container as measured in the transverse direction. The term "height" is used to describe the dimension of an element of a label or flap of a container as measured in a direction perpendicular to the width of the element. When describing a label or elements of a label, reference is generally made to the label in a flat state.

The term "inner surface" is used throughout the specification to refer to the surface of a component of the assembled container that is facing towards the interior of the container, for example towards the consumer goods, when the container is in the closed position. Likewise, the term "outer surface" is used throughout the specification to refer to the surface of a component of the container that is facing towards the exterior of the container. For example, a layer of the reclosable adhesive label comprises an outer surface that is facing away from the surface of the package and an inner surface that is facing surface of the package. It should be noted that the inside or outside surface is not necessarily equivalent to a certain side of a blank used in assembly of the container. Depending on how the blank is folded around the consumer goods, areas that are on the same side of the container can either face towards the inside or the towards the outside of the container.

The term "hinge line" refers to a line about which an element of the container may be pivoted. For example, the lid of a hinge lid container may be pivoted in order to open the container. In such case, a hinge line may be, for example, a fold line or a score line in the panel forming the back wall of the hinge lid container.

In the present specification, the terms "permanent adhesive" and "semi-permanent adhesive" refer to a generally high tack adhesive capable of forming a reliable and secure connection between two substrates—for example, between the bottom layer of the reclosable adhesive label and the package of consumer goods—such that the two substrates can substantially not be separated during the normal and intended use of the container. In fact, separation of two substrates affixed to one another by means of a permanent adhesive would typically cause some undesirable damage (for example, tearing) to one or both substrates involved.

The term "resealable adhesive" is used throughout the present specification to describe a generally low tack, removable adhesive capable of forming connection between two substrates—for example, between the top layer and the bottom layer of the reclosable adhesive label—such that the two substrates can be repeatedly separated and re-attached to one another, and such that, where the access opening of a container is resealed by means of one such adhesive, the container exhibits a significant increase in the moisture barrier properties of the container. This is in contrast to the reclosing of an access opening, for example by means of engaging flaps, where a mechanical reclosing is achieved, but at best only a minor increase in the moisture barrier properties of the container can be achieved. In a container according to the present invention, a package of consumer goods has an access opening through which consumer goods can be removed, and a reclosable adhesive label occludes the access opening and extends beyond the periphery of the access opening. The reclosable adhesive label comprises at least a bottom layer and a top layer of labelling material. The bottom layer is affixed to the package by means of a first, permanent adhesive provided on a first area of the inner surface of the bottom layer extending about the periphery of the access opening, the bottom layer comprising a cut-out portion at least partly aligned with the access opening of the package. In contrast to existing containers, the top layer is at least partly permanently affixed to the bottom layer by means of a permanent adhesive provided over a hinge area of the inner surface of the top layer located at the back of the label. In addition, the top layer is at least partly releasably affixed to the bottom layer by means of a second adhesive provided on a peeling area of the inner surface of the top layer extending distal from the hinge area. Accordingly, the top layer is movable from a closed position, wherein the top layer overlies at least the access opening, and an open position, wherein the top layer is lifted off the bottom layer to reveal the cut-out portion in the inner layer—and, effectively, to expose to the consumer the access opening in the package. The second adhesive is a permanent or semi-permanent adhesive. Further, the resealable container comprises a layer comprising a release agent provided between the bottom layer and the top layer, such that, in the closed position, a front end portion of the peeling area of the inner surface of the top layer at least partially overlies the layer comprising the release agent.

Resealable containers in accordance with the present invention provide for an easy opening by virtue of the combination of the second, resealable adhesive on the inner surface of the top layer and the release agent on the outer surface of the bottom layer. At the same time, resealable containers in accordance with the present invention provide an improved protection against the uptake or loss of moisture for the consumer products within the container, both prior to and after the first opening of the container. This is because, since the bottom layer, which is directly in contact with the package of consumer goods, is not meant to move relative to the package, a particularly strong bond between the reclosable adhesive label and the package can be achieved, for example by affixing the bottom layer to the package by means of a particularly tacky permanent adhesive. Thus, a more effective sealing of the package may be attained both prior to, and following, the first opening of the container, such that the freshness of the consumer goods within the package may be conveniently preserved for a longer period of time, and the shelf life of the product can be advantageously extended. This is particularly advantageous in the in tropical climates.

In addition, the construction of the reclosable adhesive label of containers in accordance with the invention enables an enhanced control of the force required for revealing the access opening, that is the "peel force" required to detach the top layer from the bottom layer of the reclosable adhesive label. By varying the amount of release agent provided between the top layer and the bottom layer, the peel force can advantageously be finely tuned. In addition, as will be explained in more detail below, in some embodiments it is possible to ensure that different portions of the label display different values of peel force. This makes it easier to effectively control the tension applied on the reclosable adhesive label during movement of the label between the closed and open position.

A resealable package with the reclosable adhesive label in accordance with the present invention may be received in a hinge lid housing and a connection may be provided between the reclosable adhesive label and the lid, such that movement of the lid between the closed and open positions causes the top layer of the reclosable adhesive layer to also move between the respective closed and open positions. Accordingly, the access opening of the package may be revealed "automatically", when the consumer opens the lid of the hinge lid housing. In these embodiments, being able to finely control the peel force is even more advantageous, since this enables a smoother, simultaneous opening and closing of the lid and inner package. In particular, it is possible to provide a container for consumer goods that will be generally perceived as affording an easy opening.

It has surprisingly been found that, in such containers, by virtue of the arrangement of the different adhesives over the various areas of the top and bottom layers of the reclosable adhesive label, it is particularly easy for the top layer to assume an S shape—that is, a shape that has the form of a curve with one inflexion point—when the lid is moved into the open position and the top layer is consequently lifted off the bottom layer. This is desirable in that it has been observed to be conducive to a more gradual opening and closing of the container, such that the top layer is very easy to move between the respective closed and open positions when the lid of the outer hinge lid container is moved between the closed and open position.

Further, resealable containers according to the invention are easy to manufacture and do not require any extensive modification of the existing apparatus.

In its most general terms a container according to the present invention comprises a package of consumer goods, the package having an access opening through which consumer goods can be removed. Further, the container comprises a reclosable adhesive label occluding the access opening of the package and extending beyond the periphery of the access opening of the package, wherein the reclosable adhesive label comprises at least a bottom layer and a top layer of labelling material. The bottom layer is affixed to the package by means of a first, permanent adhesive provided on a first area of the inner surface of the bottom layer extending about the periphery of the access opening, the bottom layer comprising a cut-out portion at least partly aligned with the access opening of the package. In addition, the top layer is at least partly permanently affixed to the bottom layer by means of a permanent adhesive provided on a back hinge area of the inner surface of the top layer. Further, the top layer is at least partly releasably affixed to the bottom layer by means of a second adhesive provided on a peeling area of the inner surface of the top layer extending distal from the hinge area. Thus, the top layer is movable from a closed position, wherein the top layer overlies at least the access opening, and an open position, wherein the top layer is lifted off the bottom layer to reveal the cut-out portion. The second adhesive is a permanent or semi-permanent adhesive, and the resealable container further comprises a layer comprising a release agent provided between the bottom layer and the top layer. Thus, in the closed position, a front end portion of the peeling area of the inner surface of the top layer at least partially overlies the layer comprising the release agent.

The release agent may be any one several silicone-based release agents known to the skilled person. These include a wide variety of organopolysiloxanes, with a preference for high molecular weight silicone polymers or copolymers, such as polydimethylsiloxanes, epoxypolysiloxanes, and the like. Preferably, the release agent is in the form of a printable composition. As an alternative, some suitable inks known to the skilled person may be used as the release agent. In some embodiments, the layer comprising the release agent is applied on a first area of the outer surface of the bottom layer, and the front end portion of the first area of the inner surface of the top layer at least partially overlies the first area of the outer surface of the bottom layer. Preferably, the layer comprising the release agent is applied on the first area of the outer surface of the bottom layer by a printing process. This is advantageous in that it is easy to apply a finely controlled amount of release agent on the surface at specific locations on the surface of the bottom layer.

Preferably, the first area of the outer surface of the bottom layer comprises at least a first region and a second region, the second region being at the back of the first region. A release agent coverage in the first region is greater than a release agent coverage percentage in the second region.

The expression "release agent coverage percentage" is used to describe the fraction or percentage of the surface area of a region of a surface of the reclosable adhesive label—for example, of the bottom layer of the reclosable adhesive label—that is coated or covered with the release agent. Where release agent is applied over the whole surface of a region, the release agent coverage percentage is 100. Where no release agent is applied within a region, the release agent coverage percentage is 0.

By way of example, the release agent may be applied on a region of a surface of the reclosable adhesive label in a non-continuous repeating pattern. The non-continuous repeating pattern may comprise a plurality of spaced apart rows, such as linear rows, non-linear rows, wavy rows, zigzag rows, and combinations thereof. As an alternative, regularly spaced apart dots or islands of release agent may be applied. In some embodiments, the islands of release agent may have the shape of type fonts The expression "regularly spaced apart" connotes that the distance between each dot and its neighbouring dots is substantially constant over the region. As will be understood, this can be conveniently achieved when the release agent is applied by means of a printing operation. Thus, release agent coverages ranging from 0 to 100 can advantageously be provided in the first region and the second region. For example, by applying the release agent according to a suitable pattern, 50 percent of the surface of the region can be covered with the release agent.

In the first region, the release agent coverage percentage is preferably at least about 65 percent, more preferably at least about 70 percent. In addition, or as an alternative, the release agent coverage percentage in the first region is preferably less than about 95 percent, more preferably less than about 90 percent.

In the second region, the release agent coverage percentage is preferably at least about 50 percent, more preferably at least about 60 percent. In addition, or as an alternative, the release agent coverage percentage in the second region is preferably less than about 90 percent, more preferably less than about 80 percent.

In general, peeling the top layer off a region of the bottom layer with a greater release agent coverage percentage will be easier than peeling off the top layer off a region of the bottom layer having a smaller release agent coverage percentage.

In resealable containers, it has been observed that the peel force is highest when the consumer begins to detach the label from the underlying substrate, and subsequently oscillates between local maxima and minima. The initial peak peel force has been observed to be the absolute maximum, and is generally significantly higher than the local maxima encountered subsequently.

In containers according to the present invention, wherein different regions of the surface of the bottom layer have different release agent coverage percentages, it is possible to finely tune the force required from peeling the top layer off different regions of the inner layer, such that, for example, it is particularly easy for the consumer to begin to detach the top layer from the bottom layer. Without wishing to be bound to theory, this corresponds to a significant reduction of the initial peak peel force described above, which is very advantageous in that it provides the consumer the desirable perception of a particularly easy-to-open container.

At the same time, it is possible to ensure that the resistance to peeling gradually increases as the top layer is progressively moved away from the closed position to expose the access opening of the package. This advantageously provides a desirable balance between ease of opening of the package and the need for enough adhesion between the top layer and the bottom layer for sealing and re-sealing purposes.

The first region and the second region may have any suitable shape. In some preferred embodiments, the first region and the second region are substantially rectangular. Even more preferably, the first region and the second region extend transversely across the whole width of the bottom layer, such as to define bands on the outer surface of the bottom layer.

The first region and the second region may be substantially adjacent to one another. As an alternative, the first region and the second region may be at a distance from one another with reference to a direction perpendicular to the width of the bottom layer. In some preferred embodiments, the first region and the second region define adjacent transverse bands extending transversely across the whole width of the bottom layer.

In some particularly preferred embodiments, the first area of the outer surface of the bottom layer further comprises a third region at the back of the second region. A release agent coverage in the second region is greater than a release agent coverage percentage in the third region. In the third region, the release agent coverage percentage is preferably at least about 30 percent, more preferably at least about 40 percent. In addition, or as an alternative, the release agent coverage percentage in the third region is preferably less than about 60 percent, more preferably less than about 70 percent.

In an exemplary embodiment, the release agent coverage percentage is about 95 percent in the first region, about 80 percent in the second region, and about 50 percent in the third region.

Preferably, a second area of the outer surface of the bottom layer underlying the back hinge area of the inner surface of the top layer is substantially free of release agent. By ensuring that one such area at the back of the outer surface of the bottom layer, which faces the area of the top layer over which a permanent adhesive is applied, is substantially free of release agent, a particularly solid and stable bond between the top layer and the bottom layer can advantageously be ensured. In practice, by having the two layers firmly affixed to one another at the back of the reclosable label, a strong hinge is effectively provided for the top layer to pivot about relative to the bottom layer, so that the top layer can be peeled off the bottom layer whilst remaining connected to the bottom layer at all times.

Preferably, an adhesive-free area is provided at the front end of the inner surface of the top layer. This is advantageous in that it reduces the likelihood that the top layer sticks to itself during use.

In some preferred embodiments, the cut-out portion in the inner layer is defined by lines of weakness at least partially delimiting a cover portion of the inner layer, such that the cover portion is partially separable from the remainder of the inner layer to be lifted off the top of the package to reveal the access opening. In addition, the container comprises a layer of a permanent adhesive provided on a securing area of the inner surface of the top layer, the securing area being entirely comprised within the periphery of the cover portion of the inner layer, such that the cover portion is permanently affixed to the outer layer. In such embodiments, at least a portion the outer surface of the cover portion of the bottom layer is substantially free of any release agent, such that a strong bond between the top layer and the bottom layer is ensured at all times.

Thus, in those embodiments where one or more bands comprising the release agent are provided on the outer surface of the bottom layer, these preferably do not extend across the portion of the outer area of the bottom layer underlying the securing area of the inner surface of the top layer.

In some embodiments, the securing area of the inner surface of the top layer may overlie only part of the cover portion in the bottom layer. As an alternative, the securing area may overlie the entirety of the cover portion in the bottom layer, and may even extend all the way back to the hinge area. Thus, the hinge area and the securing area together form a substantially T-shaped area comprising permanent adhesive on the inner surface of the top layer, the hinge area defining a generally thin crossbar of the T shape, with the securing area typically defining a relatively bulky stem of the T shape.

Preferably, the package is formed from a thermosealable flexible material having a moisture vapour transmission rate (MTVR) of less than about 1 g/square meter per 24 hours. More preferably, the package is formed from a thermosealable flexible laminate material comprising two or more layers, wherein one of the two or more layers comprises aluminium and has a thickness of at least about 4 micrometers. Even more preferably, the aluminium-comprising layer has a thickness of at least about 6 micrometers.

In addition, or as an alternative, the aluminium-comprising layer preferably has a thickness of less than about 12 micrometers. More preferably, the aluminium-comprising layer has a thickness of less than about 10 micrometers.

Containers according to the present invention preferably find application as containers for consumer goods, in particular elongate consumer goods such as smoking articles. However, they can also be used for several other types of consumer goods.

In some preferred embodiments, the outer layer of the reclosable adhesive label is permanently affixed to an inner surface of the lid, such that upon opening the lid the outer layer of the reclosable adhesive label is moved from the closed position towards the open position to at least partly reveal the access opening of the package.

Preferably, the resealable container comprises a layer of a primer provided on a first area of the outer surface of the top layer arranged at the front end of the top layer. This is advantageous in that the primer makes it easy for the top layer to be firmly attached to the lid of the outer hinge lid container. By strongly securing the top layer to the lid, the reliability of the "automatic" opening mechanism can be improved, since the top layer is thus less likely to detach from the lid despite the repeated opening and closing of the lid.

The term "peeling force" is used herein to describe the force required for detaching the top layer from the bottom layer of the reclosable adhesive label. It has been observed that a "peak peeling force" is generally required for starting to detach the top layer from the bottom layer, whereas a smaller force is typically required for continuing to progressively lift the remainder of the top layer off the bottom layer all the way to the back hinge area. In general, it has been observed that the peeling force oscillates between local maxima and minima as the top layer is progressively detached from the bottom layer. This also occurs in containers according to the present invention wherein the resealable container is received in the box of a hinge lid housing and the top layer is affixed to the lid, that is, wherein movement of the lid between the closed and open position is relied upon for applying a peeling force on the top layer of the reclosable adhesive label.

Thus, it is useful to refer to a "mean peeling force", that is, the average value of the peeling force function as measured over the whole relevant interval. In practice, the peeling force is measured as the top layer is peeled off the bottom layer all the way to the back hinge area (fully open position), and the mean peeling force is then calculated in accordance to the accepted definition of "mean of a function" in calculus.

Acceptable values for the mean peeling force of the reclosable adhesive label, that is, the mean force required for peeling the top layer of the label from bottom layer of the label, are considered to be from about 0.15 Newtons to about 1 Newton.

Preferably, in containers in accordance with the present invention the mean peeling force of the reclosable label is from about 0.35 to about 0.55 Newtons, more preferably from about 0.40 Newtons to about 0.50 Newtons.

Preferably, a peak peeling force required for beginning to detach the top layer from the bottom layer is less than about 10 Newtons, more preferably less than about 8 Newtons, even more preferably less than about 5 Newtons. In some preferred embodiments, the peak peeling force of the reclosable adhesive label is from about 2 Newtons to about 10 Newtons.

In addition, or as an alternative, the peak peeling force of the reclosable adhesive label is preferably less than about 12 times the mean peeling force of the reclosable adhesive label. More preferably, the peak peeling force of the reclosable adhesive label is less than 10 times the mean peeling force of the reclosable adhesive label. Even more preferably, the peak opening force is less than about 8 times the mean peeling force of the reclosable adhesive label.

The hinge lid container may be formed from a blank of any suitable material or combination of materials, including, but not limited to, cardboard, paperboard, plastic, metal, or combinations thereof. Preferably, the blank is a laminar cardboard blank having a weight of between about 100 grams per square meter and about 350 grams per square meter.

The hinge-lid container may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Suitable materials for the layers of the reclosable adhesive label will be known to the skilled person. Examples include thermoplastic materials such as polypropylene, polyethylene terephthalate, polyethylene. In a preferred embodiment, the bottom layer comprises polypropylene and the top layer comprises polyethylene terephthalate.

In some embodiments, the top layer is thicker than the bottom layer.

In containers in accordance with the present invention, the top layer preferably has a thickness of at least about 30 micrometers. More preferably, the top layer has a thickness of at least about 35 micrometers. In addition, or as an alternative, the top layer preferably has a thickness of less than about 70 micrometers. More preferably, the top layer has a thickness of less than about 60 micrometers. In preferred embodiments, the top layer has a thickness of about 50 micrometers.

The bottom layer preferably has a thickness of at least about 20 micrometers. More preferably, the bottom layer has a thickness of at least about 25 micrometers. In addition, or as an alternative, the bottom layer has a thickness of less than about 40 micrometers. More preferably, the bottom layer has a thickness of less than about 35 micrometers. In preferred embodiments, the bottom layer has a thickness of about 30 micrometers.

In some preferred embodiments of containers in according with the present invention, the top layer has a thickness of about 50 micrometers and the bottom layer has a thickness of about 30 micrometers.

Several resealable, semi-permanent and permanent adhesives suitable for use in a container according to the present invention are commercially available and will be known to the skilled person.

The outer hinge lid container is preferably a rectangular parallelepiped comprising two wider walls spaced apart by two narrower walls. Hinge lid containers according to the invention may be in the shape of a rectangular parallelepiped, with right-angled longitudinal and right-angled transverse edges. Alternatively, the hinge lid container may comprise one or more rounded longitudinal edges, rounded transverse edges, bevelled longitudinal edges or bevelled transverse edges, or combinations thereof.

The invention will now be further described, by way of example only, with reference to the accompanying drawings in which.

Figure 1:
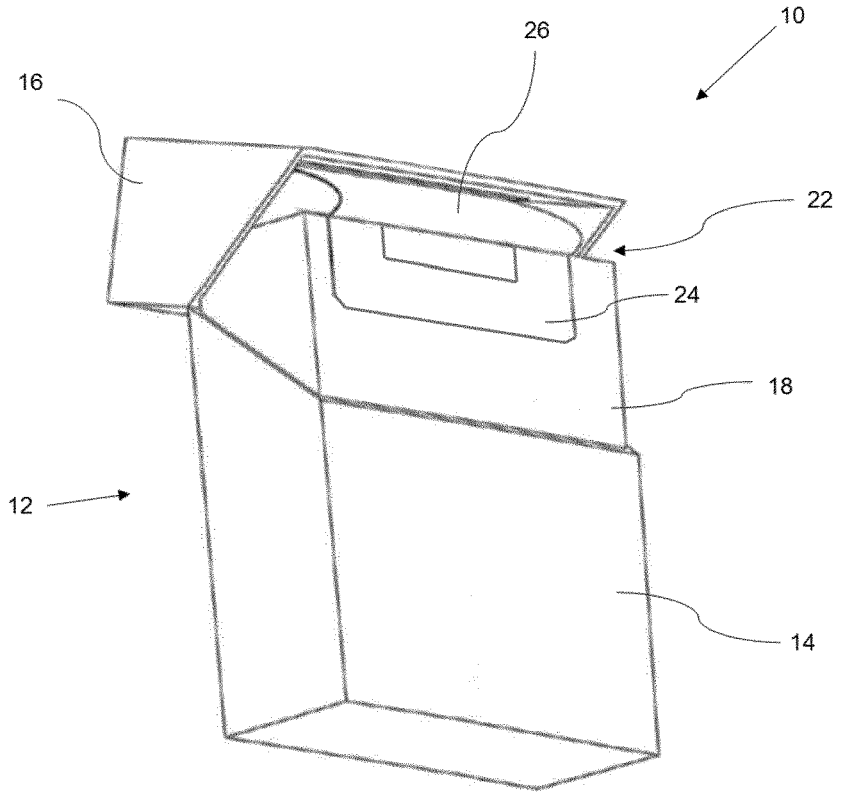
FIG. 1 is a schematic perspective view of a container in accordance with the present invention.

FIG. 1 shows a container 10 in accordance with the present invention. The container 10 comprises an outer housing 12 which is a rectangular parallelepiped and includes a box 14 and a lid 16. The lid 16 is hinged about a hinge line extending across a back wall of the housing 12 and is pivotable between an open position (shown in FIG. 1) and a closed position. Further, the container 10 comprises an inner package 18 of smoking articles housed in the box 14. The inner package 18 comprises an access opening extending across the top wall and the front wall of the inner package. The smoking articles contained in the inner package 18 can be removed through the access opening when the lid 16 is in the open position. The inner package 18 comprises a reclosable adhesive label 22 occluding the access opening of the package and extending beyond the periphery of the access opening of the package. In more detail, the reclosable adhesive label 22 comprises at least a bottom layer 24 and a top layer 26 of labelling material. The bottom layer 24 comprises polypropylene and has a thickness of about 30 micrometers. The top layer 26 comprises polyethylene terephthalate and has a thickness of about 50 micrometers.

Figure 2:
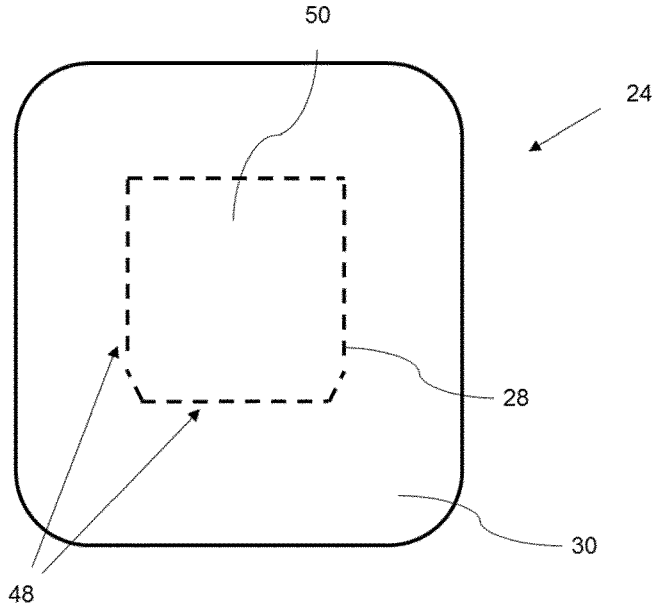
FIG. 2 is a schematic top view of the inner surface of the bottom layer of a label for a container in accordance with the present invention.

The bottom layer 24 comprises a cut-out portion 28 at least aligned with the access opening 20 of the inner package 18 and is affixed to the inner package 18 by means of a first, permanent adhesive provided on a first area 30 of the inner surface of the bottom layer 24 (see FIG. 2) extending about the periphery of the access opening.

Figure 4:
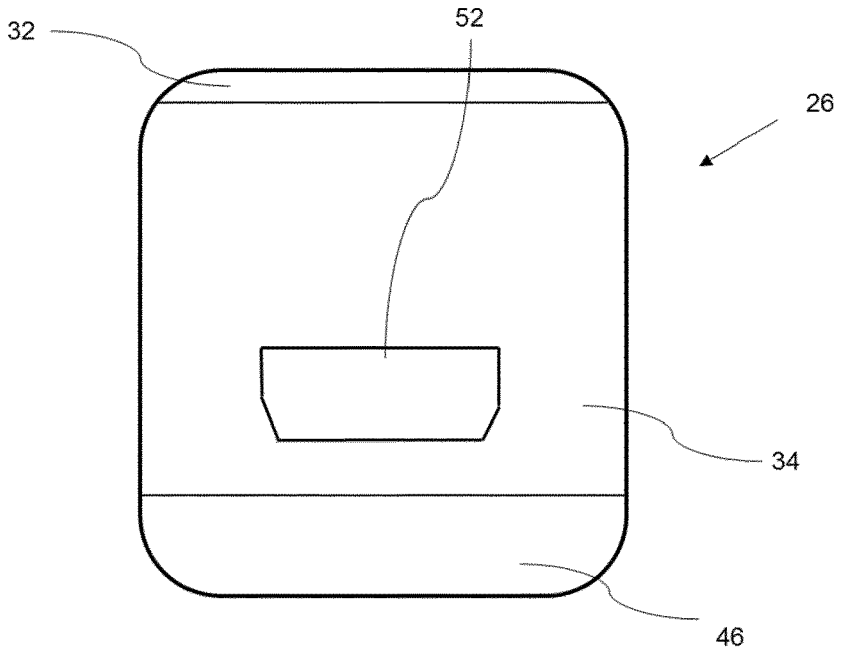
FIG. 4 is a schematic top view of the inner surface of the top layer of the label of FIG. 2.

The top layer 26 is partly permanently affixed to the bottom layer 24 by means of a permanent adhesive provided on a back hinge area 32 of the inner surface of the top layer 26 (see FIG. 4). In addition, the top layer 26 is partly releasably affixed to the bottom layer 24 by means of a second adhesive provided on a peeling area 34 of the inner surface of the top layer (see FIG. 5) extending distal from the back hinge area 32, such that the top layer 26 is movable from a closed position, wherein the top layer 26 overlies at least the access opening 20, and an open position, wherein the top layer 26 is lifted off the bottom layer 24 to reveal the cut-out portion 28. The second adhesive is a permanent adhesive. The top layer 26 is also permanently affixed to an inner surface of the lid 16, such that upon opening the lid 16 the top layer 26 of the reclosable adhesive label 22 is moved from the closed position towards the open position to at least partly reveal the access opening 20.

In addition, the resealable container 10 comprises a layer comprising a silicone based release agent provided between the bottom layer 24 and the top layer 26, such that, in the closed position, a front end portion of the peeling area 34 of the inner surface of the top layer at least partially overlies the layer comprising the release agent. In more detail, the layer comprising the release agent is applied by printing on a first area 36 of the outer surface of the bottom layer 24 (see FIG. 3), the front end portion of the peeling area 34 of the inner surface of the top layer 26 at least partially overlying the first area 36 of the outer surface of the bottom layer 24.

Figure 3:
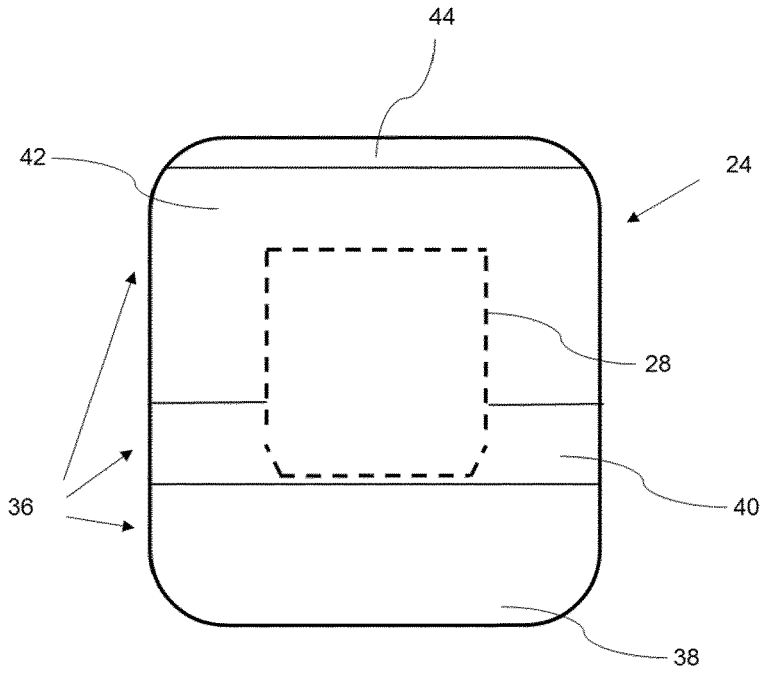
FIG. 3 is a schematic top view of the outer surface of the bottom layer of the label of FIG. 2.

As illustrated in FIG. 3, the first area 36 of the outer surface of the bottom layer 24 comprises at least a first region 38, a second region 40, and a third region 42. The second region 40 is substantially adjacent to, and at the back of, the first region 38. The third region 42 is substantially adjacent to, and at the back of, the second region 40. In the first region 38, the release agent coverage percentage is about 95 percent. In the second region 40, the release agent coverage percentage is about 80 percent. In the third region 42, the release agent coverage percentage is about 50 percent.

A second area 44 of the outer surface of the bottom layer 24 underlying the back hinge area 30 of the inner surface of the top layer 26 is substantially free of release agent. In addition, as illustrated in FIG. 4, a further area 46 of the inner surface of the top layer arranged at the front end of the top layer 26 is substantially free of adhesive.

In the embodiment shown in FIGS. 2 to 5, the cut-out portion 28 in the inner layer 24 is defined by lines of weakness 48 at least partially delimiting a cover portion 50 of the inner layer 24. Thus, the cover portion 50 is partially separable from the remainder of the inner layer 24 to be lifted off the top of the inner package 18 to reveal the access opening 20. At least a portion of the outer surface of the cover portion 50 is substantially free of release agent. Further, the container 10 comprises a layer of a permanent adhesive provided on a securing area 52 of the inner surface of the top layer (see FIG. 4), a periphery of the securing area being entirely comprised within the periphery of the cover portion 50 of the inner layer. Thus, the cover portion 50 is permanently affixed to the outer layer 24.

Figure 5:
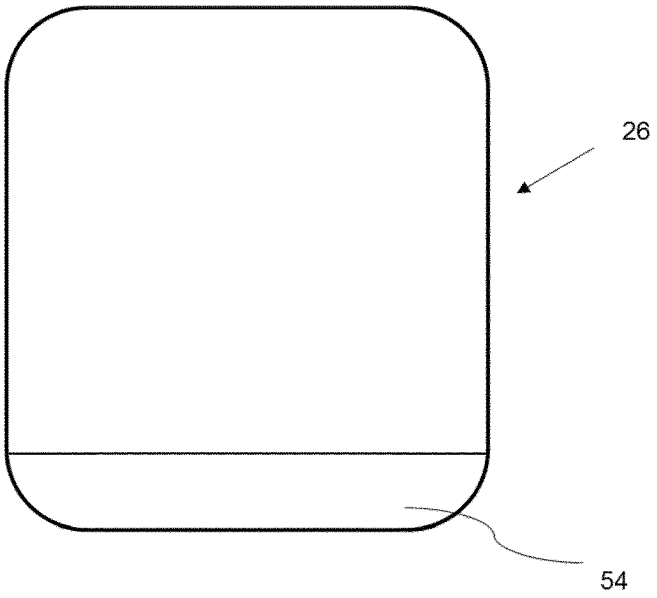
FIG. 5 is a schematic top view of the outer surface of the top layer of the label of FIG. 2.

As illustrated in FIG. 5, a layer of primer is provided on a first area 54 of the outer surface of the top layer arranged at the front end of the top layer 26. The top layer 26 of the reclosable adhesive label 22 is strongly affixed to the lid 16 of the outer housing 12 by a permanent adhesive provided over the layer of primer in the first area 54.

Figure 6:
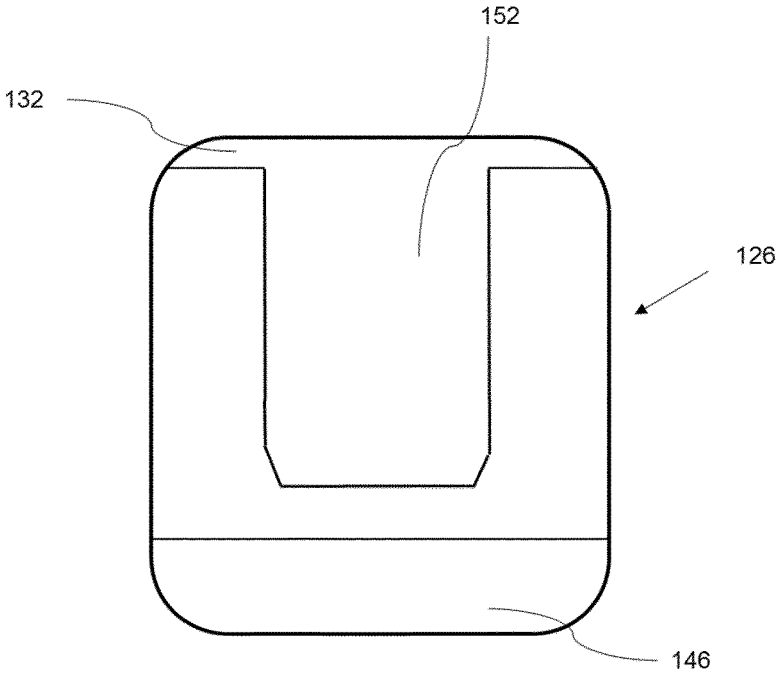
FIG. 6 is a schematic top view of the inner surface of the top layer of another embodiment of a label for a container in accordance with the present invention.

A further embodiment of a reclosable adhesive label for use in a container in accordance with the present invention is illustrated with reference to FIG. 6, which shows the inner surface of the top layer 126 of the reclosable adhesive label. The top layer 126 may, for example, be combined with the bottom layer of FIGS. 2 and 3 to provide a reclosable adhesive label for use in a container in accordance with the present invention.

In one such embodiment, a layer of permanent adhesive is provided on a securing area 152 of the inner surface of the top layer 126. The securing area 152 overlies the entirety of the cover portion in the bottom layer, and effectively extends all the way back to the back hinge area 130. Thus, the hinge area 132 and the securing area 152 together form a substantially T-shaped area comprising permanent adhesive on the inner surface of the top layer. The back hinge area 130 defines a crossbar of the T shape, with the securing area 152 defining a bulky stem of the T shape. Further, a tab-defining area 146 of the inner surface of the top layer arranged at the front end of the top layer 126 is substantially free of adhesive.

The invention claimed is:

1. A resealable container for consumer goods comprising:

a package of consumer goods, the package having an access opening through which consumer goods can be removed; and a reclosable adhesive label occluding the access opening of the package and extending beyond the periphery of the access opening of the package, wherein the reclosable adhesive label comprises at least a bottom layer and a top layer of labelling material;

the bottom layer being affixed to the package by a first, permanent adhesive provided on a first area of the inner surface of the bottom layer extending about the periphery of the access opening, the bottom layer comprising a cut-out portion at least partly aligned with the access opening of the package; and the top layer being at least partly permanently affixed to the bottom layer by a permanent adhesive provided on a back hinge area of the inner surface of the top layer, and at least partly releasably affixed to the bottom layer by a second adhesive provided on a peeling area of the inner surface of the top layer extending distal from the hinge area, such that the top layer is movable from a closed position, wherein the top layer overlies at least the access opening, and an open position, wherein the top layer is lifted off the bottom layer to reveal the cut-out portion;

wherein the second adhesive is a permanent adhesive and the resealable container further comprises a layer comprising a release agent provided between the bottom layer and the top layer and applied on a first area of the outer surface of the bottom layer, such that, in the closed position, a front end portion of the peeling area of the inner surface of the top layer at least partially overlies the first area of the outer surface of the bottom layer and the layer of release agent; wherein the first area of the outer surface of the bottom layer comprises at least a first region and a second region, the second region being at the back of the first region; and wherein a release agent coverage percentage in the first region is greater than a release agent coverage percentage than in the second region.

2. A resealable container according to claim 1, wherein the layer comprising the release agent is printed on the first area of the outer surface of the bottom layer.

3. A resealable container according to claim 1, wherein the release agent percentage coverage in the first region is from about 65 percent to about 95 percent.

4. A resealable container according to claim 1, wherein the release agent percentage coverage in the second region is from about 40 percent to about 60 percent.

5. A resealable container according to claim 1, wherein a second area of the outer surface of the bottom layer underlying the back hinge area of the inner surface of the top layer is substantially free of release agent.

6. A resealable container according to claim 1, wherein the cut-out portion in the inner layer is defined by lines of weakness at least partially delimiting a cover portion of the inner layer, such that the cover portion is partially separable from the remainder of the inner layer to be lifted off the top of the package to reveal the access opening, at least a portion of the outer surface of the cover portion being substantially free of release agent; and wherein the container comprises a layer of a permanent adhesive provided on a securing area of the inner surface of the top layer, a periphery of the securing area being entirely comprised within the periphery of the cover portion of the inner layer, such that the cover portion is permanently affixed to the outer layer.

7. A resealable container according to claim 1, wherein the package is formed from a thermosealable flexible material having a moisture vapour transmission rate (MTVR) of less than about 1 gram/square meter per 24 hours.

8. A resealable container according to claim 1, wherein the package is formed from a thermosealable flexible laminate material comprising two or more layers, wherein one of the two or more layers comprises aluminium and has a thickness of at least about 4 micrometers.

9. A resealable container according to claim 1, wherein the consumer goods are smoking articles.

10. A hinge lid container according to claim 8, wherein the top layer of the reclosable adhesive label is permanently affixed to an inner surface of the lid, such that upon opening the lid the top layer of the reclosable adhesive label is moved from the closed position towards the open position to at least partly reveal the access opening.

11. A hinge lid container according to claim 9, wherein the resealable container comprises a layer of a primer provided on a first area of the outer surface of the top layer arranged at the front end of the top layer.

12. A hinge lid container according to claim 9, wherein a peak peeling force of the reclosable adhesive label is less than about 10 Newtons.

13. A hinge lid container for consumer goods, comprising:

a box;

a lid hinged to the box along a hinge line extending across a back wall of the hinge lid container; and a resealable container according to claim 1 within the box.

* * * * *